US009608322B2

(12) United States Patent
Yu et al.

(10) Patent No.: US 9,608,322 B2
(45) Date of Patent: Mar. 28, 2017

(54) ELECTRONIC DEVICE HAVING ANTENNA

(71) Applicants: HONG FU JIN PRECISION INDUSTRY (ShenZhen) CO., LTD., Shenzhen (CN); HON HAI PRECISION INDUSTRY CO., LTD., New Taipei (TW)

(72) Inventors: Zhi-Cheng Yu, Shanghai (CN); Cheng-Qiu Wei, Shanghai (CN)

(73) Assignees: HONG FU JIN PRECISION INDUSTRY (ShenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 37 days.

(21) Appl. No.: 14/824,776

(22) Filed: Aug. 12, 2015

(65) Prior Publication Data

US 2016/0240917 A1 Aug. 18, 2016

(30) Foreign Application Priority Data

Feb. 13, 2015 (CN) ..... 2015 1 0080689

(51) Int. Cl.

| | |
|---|---|
| ***H01Q 1/44*** | (2006.01) |
| ***H01H 9/02*** | (2006.01) |
| ***H01H 13/702*** | (2006.01) |
| ***H01Q 7/00*** | (2006.01) |
| ***H01Q 1/36*** | (2006.01) |

(52) U.S. Cl.

CPC ..... *H01Q 1/44* (2013.01); *H01H 9/0271* (2013.01); *H01H 13/702* (2013.01); *H01Q 1/36* (2013.01); *H01Q 7/00* (2013.01)

(58) Field of Classification Search

CPC ..... H01Q 1/44; H01Q 1/36; H01Q 7/00
USPC ..... 343/720
See application file for complete search history.

(56) References Cited

U.S. PATENT DOCUMENTS

| | | | | |
|---|---|---|---|---|
| 7,209,281 | B2 * | 4/2007 | Takei | G02F 1/167 345/107 |
| 9,466,883 | B2 * | 10/2016 | Li | H01Q 1/38 |
| 2004/0056804 | A1 * | 3/2004 | Kadambi | H01Q 1/243 343/700 MS |
| 2005/0007296 | A1 * | 1/2005 | Endo | G06K 19/0726 343/895 |
| 2009/0146898 | A1 * | 6/2009 | Akiho | H01Q 1/243 343/787 |
| 2009/0201116 | A1 * | 8/2009 | Orihara | G06K 19/07749 336/200 |
| 2014/0225784 | A1 * | 8/2014 | Li | H01Q 1/38 343/700 MS |
| 2015/0102978 | A1 * | 4/2015 | Wang | H01Q 1/38 343/893 |

* cited by examiner

*Primary Examiner* — Huedung Mancuso
(74) *Attorney, Agent, or Firm* — Zhigang Ma

(57) ABSTRACT

An electronic device includes a printed circuit board (PCB), an antenna and a switch. The antenna is printed on the PCB. The antenna includes multiple key contacts. Each of the multiple key contacts includes a first terminal, a second terminal and a third terminal. The first terminal is an output terminal. The second terminal and the third terminal are connected in series in the antenna. The switch switches the electronic device to an input mode and an antenna mode, thus the electronic device can be alternatively switched to an input function or a communication function.

13 Claims, 4 Drawing Sheets

ELECTRONIC DEVICE HAVING ANTENNA

FIELD

The subject matter herein generally relates to electronic devices, more particularly to an electronic device having an antenna.

BACKGROUND

Nowadays, an electronic device includes various functions. More and more antennas are applied in an electronic device, thus, limiting the space in the electronic device to accommodate various antennas.

BRIEF DESCRIPTION OF THE DRAWINGS

Implementations of the present technology will now be described, by way of example only, with reference to the attached figures.

DETAILED DESCRIPTION

Figure 1:
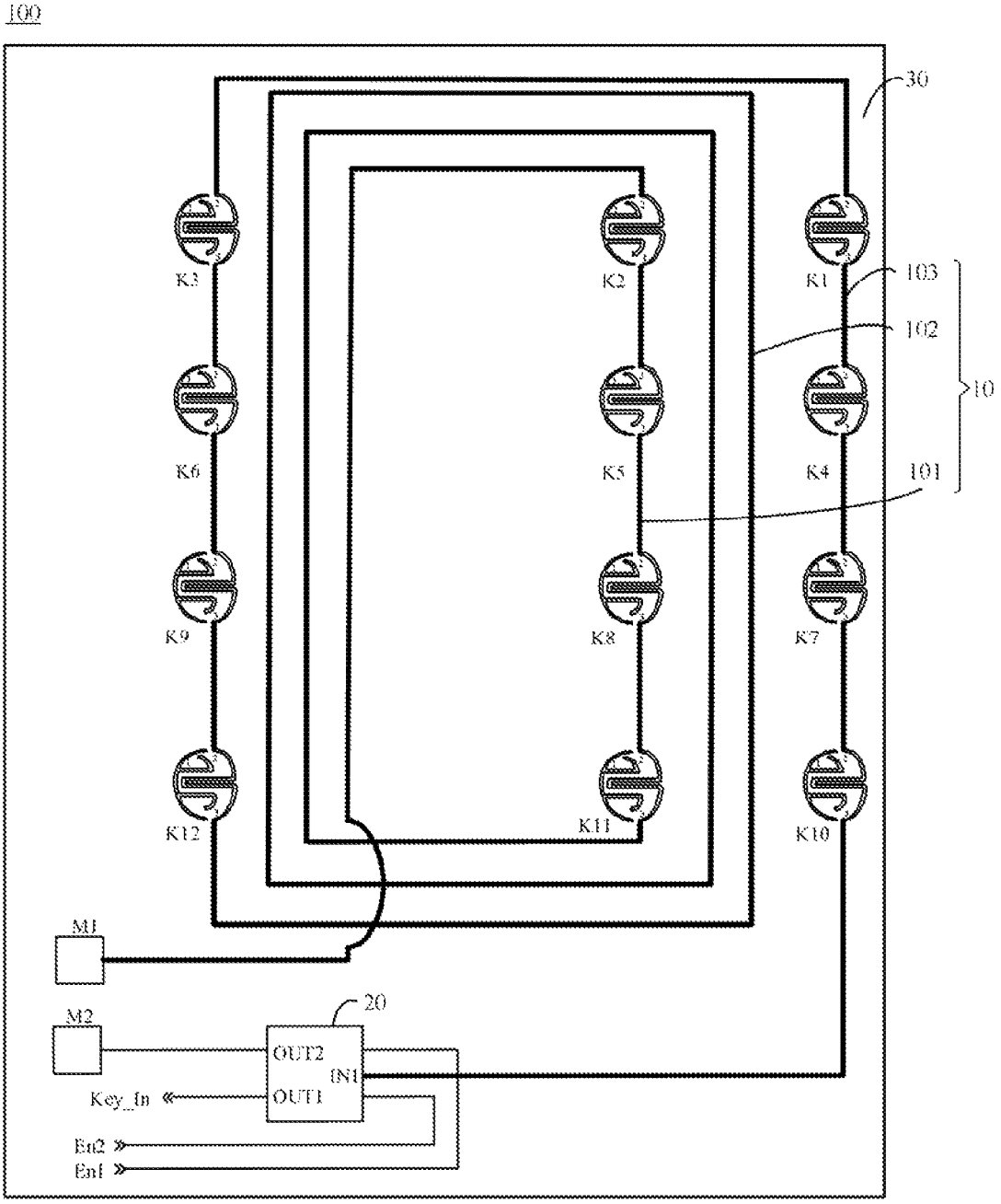
FIG. 1 illustrates a diagrammatic view of an electronic device having an antenna.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The term "comprising" when utilized, means "including, but not necessarily limited to", it specifically indicates open-ended inclusion or membership in the so-described combination, group, series and the like.

The present disclosure is described in relation to an electronic device 100 with an antenna including key contacts.

FIG. 1 illustrates a diagrammatic view of an electronic device 100 with an antenna including key contacts.

In at least one embodiment, the electronic device 100 includes multiple key contacts K1-K12, an antenna 10, a switch 20 and a printed circuit board (PCB) 30. In other embodiments, the quantity of the multiple key contacts can be changed as required.

The antenna 10 is printed on the PCB 30. The antenna 10 can be a micro-strip antenna. Each of the key contacts K1-K12 includes a first terminal 1, a second terminal 2 and a third terminal 3. Each first terminal 1 of the key contacts K1-K12 is an output terminal. Each second terminal 2 and each third terminal 3 are connected in series in the antenna 10.

The switch 20 is coupled to the antenna 10 and switches the electronic device 100 to an input mode or an antenna mode, thus, the electronic device can be alternatively switched to an input function or a communication function.

When the electronic device 100 is switched to the input mode, the communication function using the antenna 10 is disabled; the electronic device 100 receives and recognizes input signals of the key contacts K1-K12.

When the electronic device 100 is switched to the antenna mode, the input function is disabled; the electronic device 100 communicates by transmitting signals through the antenna 10.

In at least one embodiment, the key contacts K1-K12 can be micro strips printed on the PCB 30 or contact buttons. In at least one embodiment, in order to transceive signals, a first connection M1 and a second connection M2 are set on the PCB 30 as input/output terminals connected to other circuits. The electronic device 100 can be a telephone or a computer or a cell phone etc. The antenna 10 can be a Near Field Communication (NFC) antenna.

In at least one embodiment, the antenna 10 is a spiral-shaped micro-strip antenna coil including an inner circuit 101, a middle circuit 102 and an outer circuit 103. The inner circuit 101, the middle circuit 102 and the outer circuit 103 are coils with several wraps. The inner circuit 101, the middle circuit 102 and the outer circuit 103 are connected end to end in series to form a spiral-shaped coil. Moreover, each wrap in the spiral-shaped coil is equidistance with neighboring wraps. In other embodiments, the distance between neighboring wraps can be unequal as required.

In at least one embodiment, the key contacts K1-K1 are arranged in a rectangular array to form keypads. In the antenna 10, keypads are connected in series to form a spiral-shaped coil. In some embodiments, the key contacts K1-K1 can be circularly arranged to form keypads.

Figure 2:
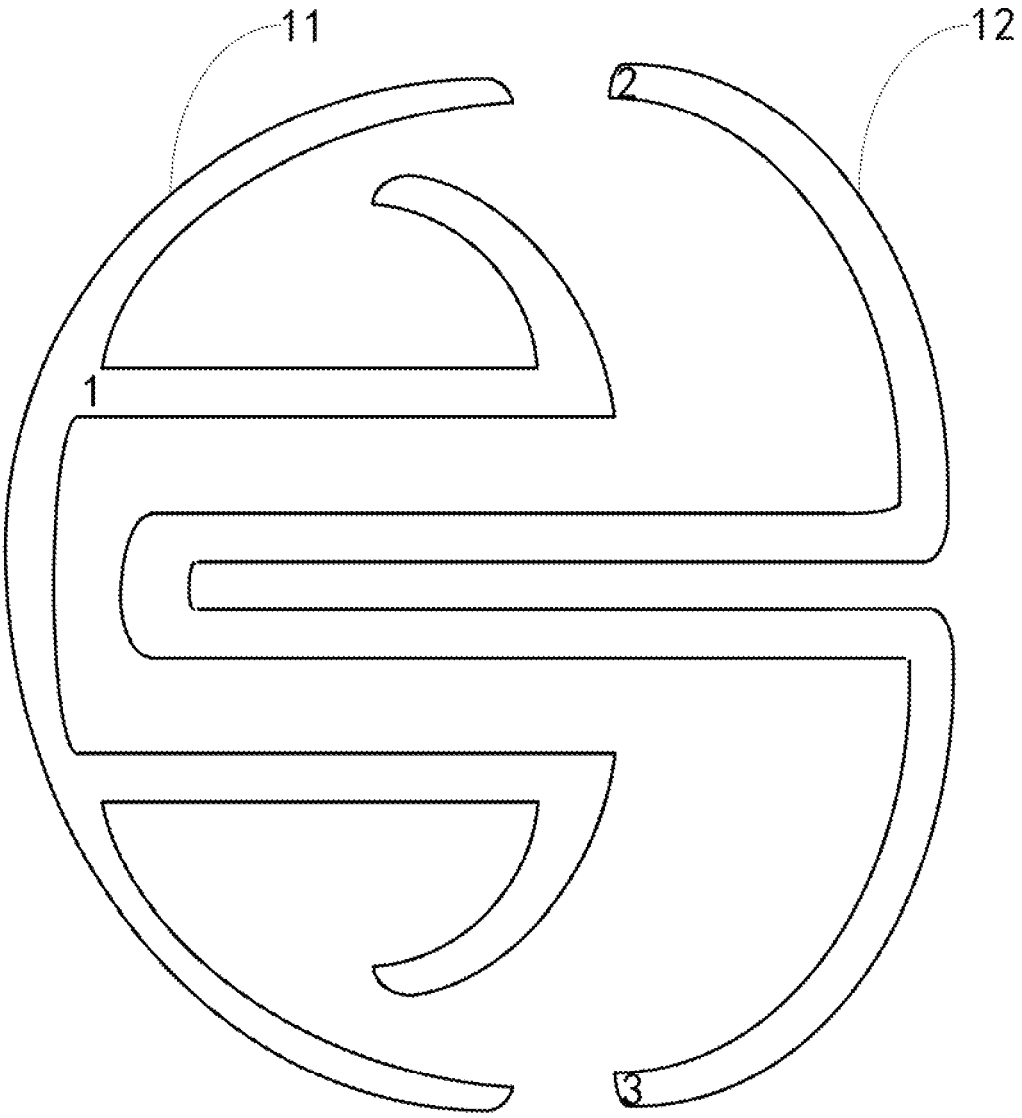
FIG. 2 illustrates a diagrammatic view of a key contact in the electronic device of FIG. 1.
Figure 3:
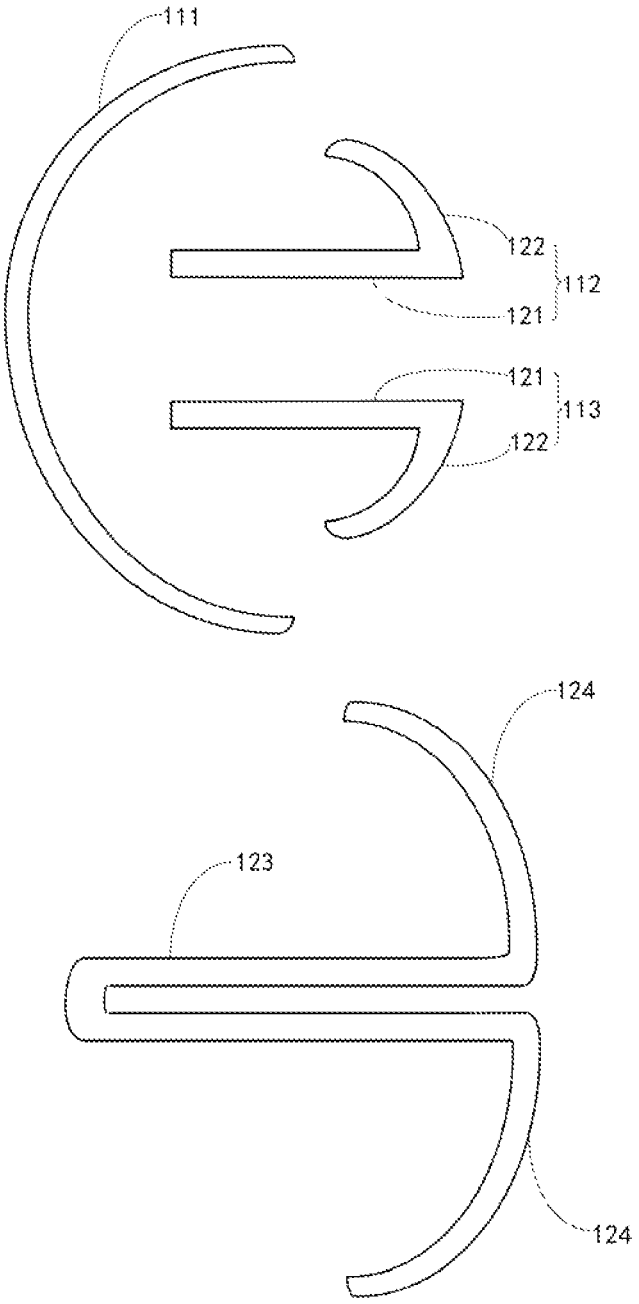
FIG. 3 illustrates an exploded view of the key contact of FIG. 2.

As shown in FIG. 2 and FIG. 3, each of the key contacts K1-K12 includes a first portion 11 and a second portion 12. The first portion 11 includes an arc-shaped portion 111 and two bent portions 112 and 113. Each of the bent portions 112 and 113 includes a first straight portion 121 and a first hooked portion 122.

A first end of the first straight portion 121 connects to the arc-shaped portion 111. A second end of the first straight portion 121 connects to the first hooked portion 122. The first straight portion 121 in the bent portion 112 is parallel to the first straight portion 121 in the bent portion 113. Thus, the two first straight portions 121 and the arc-shaped portion 111 form a surrounding area. The two first hooked portions 122 the bent portions 112 and 113 are symmetric. The connection portion of the bent portion 112 and the arc-shaped portion 111 is a first terminal 1 in each of the key contacts K1-K12.

The second portion 12 includes a second straight portion 123 and two second hooked portions 124. The second straight portion 123 is U-shaped and accommodates in the surrounding area. First ends of the two second hooked portions 124 connect to two ends of the second straight portion 123 respectively. The two second hooked portions 124 are symmetric. Second ends of the two second hooked portions 124 are respectively the second terminal 2 and the third terminal 3 of each of the key contacts K1-K12.

The inner circuit 101 includes micro strips and at least one key contact. The micro strips connect to the second terminal and the third terminal of the key contact in sequence.

The outer circuit 103 includes micro strips and at least one key contact. The micro strips connect to the second terminal and the third terminal of the key contact in sequence.

Thus, there are no stub lines in the antenna 10. The performance in the antenna 10 is enhanced.

In at least one embodiment, the switch 20 includes an input terminal IN1, a first output terminal OUT1, a second output terminal OUT2, a first enable terminal EN1 and a second enable terminal EN2. The input terminal IN1 connects to the antenna 10. The first output terminal OUT1 connects to some controllers or circuits. The controllers or circuits transmit and receive signals of the key contacts K1-K12. The second output terminal OUT2 connects to some antenna controllers or circuits. The antenna controllers or circuits are configured to communicate with other devices through the antenna 10. The first enable terminal EN1 and the second enable terminal EN2 receive enable signals to connect the input terminal IN1 to the first output terminal OUT1 or connect the input terminal IN1 to the second output terminal OUT2. Thus, the electronic device 100 can be alternatively switched to the input mode and the antenna mode.

In at least one embodiment, when the first enable terminal EN1 receives a high level voltage and the second enable terminal EN2 receives a low level voltage, the input terminal IN1 connects to the first output terminal OUT1. The electronic device 100 is switched to the input mode.

In at least one embodiment, when the first enable terminal EN1 receives a low level voltage and the second enable terminal EN2 receives a high level voltage, the input terminal IN1 connects to the second output terminal OUT2. The electronic device 100 is switched to the antenna mode.

In at least one embodiment, the electronic device 100 is switched to the input mode in initial condition. In some embodiments, the electronic device 100 can be switched to the input mode or the antenna mode in initial condition as required. In some embodiments, the electronic device 100 can be switched to the input mode when the time the electronic device 100 operates in the antenna mode is longer than a preset time. The preset time can be 5 seconds or any time as required.

Figure 4:
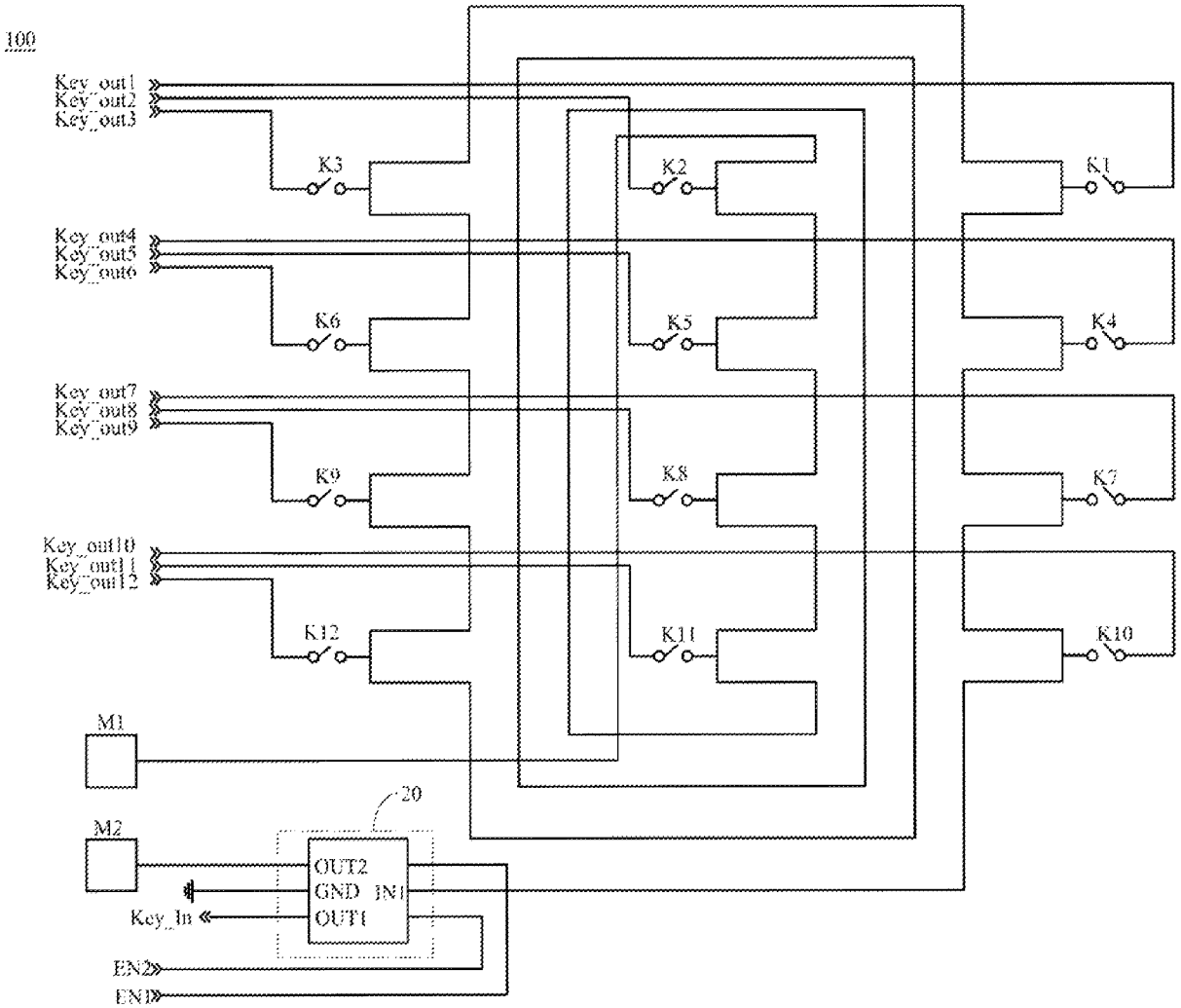
FIG. 4 illustrates another diagrammatic view of an electronic device having an antenna.

FIG. 4 illustrates another diagrammatic view of an electronic device 100 with an antenna including key contacts.

In at least one embodiment, multiple receiving terminals Key_out1-Key_out12 are set in the PCB 30, configured to receive information of keypad pressing. First terminals 1 of the key contacts K1-K12 are connected correspondingly to the receiving terminals Key_out1-Key_out12. Thus, the electronic device 100 can identify which key contact of the key contacts K1-K12 is pressed.

When the electronic device 100 is switched to the input mode and the signal input pin Key_In is in a high level voltage, the high level voltage transmits to the antenna 10 through the first output terminal OUT1 and the input terminal IN1. At the time, if one of the key contacts K1-K12 is pressed, terminals in the receiving terminals Key_out1-Key_out12 correspondingly transmit the high level voltage. Thus, the electronic device 100 identifies which key contact of the key contacts K1-K12 is pressed.

Many details are often found in the art such as the other features of the electronic device having an antenna. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An electronic device having an antenna, the antenna comprising:

a printed circuit board;

an antenna printed on the printed circuit board, wherein the antenna comprises multiple key contacts, each of the key contacts comprises a first terminal, a second terminal and a third terminal, the first terminal is an output terminal, the second terminal and the third terminal are connected in series in the antenna; and a switch connected to the antenna, configured to alternatively switch to an input mode and an antenna mode.

2. The electronic device having an antenna as claimed in claim 1, wherein the antenna is a spiral-shaped coil comprising an inner circuit, a middle circuit and an outer circuit.

3. The electronic device having an antenna as claimed in claim 2, wherein the inner circuit, the middle circuit and the outer circuit are coils with several wraps.

4. The electronic device having an antenna as claimed in claim 3, wherein each wrap in the coils is equidistance with neighboring wraps.

5. The electronic device having an antenna as claimed in claim 2, wherein the key contacts are arranged in a rectangular array to form keypads, and the keypads are connected in series to form the spiral-shaped coil.

6. The electronic device having an antenna as claimed in claim 2, wherein the inner circuit comprises micro strips and at least one key contact, and the micro strips connect to the second terminal and the third terminal of the key contact in sequence.

7. The electronic device having an antenna as claimed in claim 2, wherein the outer circuit comprises micro strips and at least one key contact, and the micro strips connect to the second terminal and the third terminal of the key contact in sequence.

8. The electronic device having an antenna as claimed in claim 1, wherein the switch comprises a first enable terminal and a second enable terminal, and the first enable terminal and the second enable terminal are configured to switch to the input mode or the antenna mode.

9. The electronic device having an antenna as claimed in claim 1, wherein each of the multiple key contacts comprises a first portion and a second portion, the first portion is a symmetric structure, and a second portion is also a symmetric structure.

10. The electronic device having an antenna as claimed in claim 9, wherein the second portion comprises a second straight portion and two second hooked portions.

11. The electronic device having an antenna as claimed in claim 10, wherein the second straight portion is U-shaped.

12. The electronic device having an antenna as claimed in claim 10, wherein the two second hooked portions are symmetric.

13. The electronic device having an antenna as claimed in claim 10, wherein first ends of the two second hooked portions connect to two ends of the second straight portion respectively.

* * * * *